United States Patent [19]

Torniainen

[11] 4,426,868

[45] Jan. 24, 1984

[54] APPARATUS AND METHOD FOR FORMING FINS ON A TUBE SURFACE

[75] Inventor: Matti J. Torniainen, Gloversville, N.Y.

[73] Assignee: Carrier Corporation, Syracuse, N.Y.

[21] Appl. No.: 339,027

[22] Filed: Jan. 13, 1982

[51] Int. Cl.[3] ..... B21H 3/04

[52] U.S. Cl. ..... 72/98; 72/104

[58] Field of Search ..... 72/71, 78, 98, 103, 72/104, 118; 10/152 R; 29/159.3 AH

[56] References Cited

U.S. PATENT DOCUMENTS

| | | | |
|---|---|---|---|
| 2,645,954 | 7/1953 | Pfingston | 72/118 |
| 3,600,922 | 8/1971 | Schmeling et al. | 72/98 |
| 4,159,739 | 7/1979 | Brothers et al. | 165/133 |
| 4,168,618 | 9/1979 | Saier et al. | 72/71 |

*Primary Examiner*—Lowell A. Larson
*Attorney, Agent, or Firm*—David L. Adour

[57] ABSTRACT

Apparatus and method for forming fins on a tube surface. The apparatus comprises a plurality of roller assemblies and each roller assembly includes first and second spaced apart sets of discs. The first set of discs have progressively increasing outside diameters in a forward direction. The second set of discs includes a first subset of discs having outside diameters generally equal to the outside diameter of the forwardmost disc in the first set, and a second subset of discs having progressively increasing outside diameters in the forward direction, with the outside diameter of the forwardmost disc in the second subset generally equal to the outside diameter of the forwardmost disc in the first set.

6 Claims, 3 Drawing Figures

APPARATUS AND METHOD FOR FORMING FINS ON A TUBE SURFACE

BACKGROUND OF THE INVENTION

This invention generally relates to methods and apparatus for forming fins on the outside surface of a tube, and more specifically, to methods and apparatus particularly well suited for forming high pitch fins on the outside surface of a tube.

In many heat transfer applications, a first fluid is conducted through the inside of a tube and a second fluid is conducted over the exterior thereof to transfer heat between the first and second fluids. Many factors, for example the thickness of the tube wall and the material from which the tube is made, affect the heat transfer performance of the tube. The amount of outside surface area on a tube also affects the heat transfer characteristics thereof; and as a general rule, increasing this surface area on a tube improves the heat transfer performance thereof.

The outside surface area of a tube can be, and often is, increased by forming external fins on the outside of the tube. Generally, increasing the number of fins per unit length of a tube—a ratio referred to herein as the fin pitch of the tube—increases the outside surface area of the tube and, hence, improves the heat transfer characteristics thereof. However, increasing the fin pitch of a tube also usually increases the cost of forming the tube fins; and with prior art tube finning methods and apparatus, it has generally not been cost effective to provide tubes with a fin pitch greater than approximately 16 fins per centimeter (40 fins per inch). That is, with prior art tube finning methods and apparatus, the increased cost of providing a tube with a fin pitch greater than approximately 16 fins per centimeter has typically not been justified by the improved heat transfer performance of the tube.

To elaborate, conventional tube finning apparatus comprise a triad of substantially identical roller assemblies. Each roller assembly, in turn, comprises a rotatable arbor and a plurality of contiguous discs mounted on the arbor for unitary rotation therewith. These discs have uniform widths and progressively increasing outside diameters in a forward direction. The roller assemblies are positioned in a finning machine with the longitudinal axes of the roller assemblies laterally spaced from, substantially equally spaced around, and slightly skewed relative to a central longitudinal axis along which a tube is advanced during a finning operation. To form fins on the outside surface of a tube, the tube is aligned with this central longitudinal axis, between the roller assemblies; and then the roller assemblies are moved toward the tube, bringing the rearwardmost or lead discs of the roller assemblies into pressure engagement with the outside surface of the tube. Each roller assembly is then rotated about its own axis, rotating the lead discs of the roller assemblies against the tube surface.

This rotation of the lead discs rotates the tube about its own longitudinal axis and forms one or more small helical groove or grooves in the outside surface of the tube, with the number of grooves that are formed determined by the angle between the longitudinal axes of the tube and the roller assemblies. The rotation of the lead discs against the tube, because of the skewed angle between the longitudinal axes of the tube and the roller assemblies, also longitudinally advances the tube so that the formed groove or grooves helically extend around the outside surface of the tube. As the tube longitudinally moves forward, each groove is sequentially engaged by successive discs having successively increasing outside diameters. These discs enlarge the groove or grooves and extrude tube material outward, between adjacent discs. The outside annular surface of each disc has a curved or arcuate profile, curving radially inward from a central annular edge, and the arcuate profiles of adjacent discs shape the extruded tube material into a helical fin or fins extending around the outside surface of the tube.

With this arrangement, the distance between corresponding points of adjacent groove convolutions and between corresponding points of adjacent fin convolutions along a longitudinal cross section of the tube equals the width of the individual finning discs. Since the distance between corresponding points of adjacent fin convolutions is inversely proportional to the fin pitch, the fin pitch of a tube can be increased by using thinner discs to form the tube grooves and fins.

However, the discs employed in the tube finning operation are subjected to considerable stresses as they extrude material to form the tube fins and grooves; and decreasing the thickness of the individual discs, decreases the strength of those discs and tends to increase the number and frequency of broken discs. Should a disc break, of course, the finning process must be eventually terminated and the broken disc replaced. This is quite costly, not only because of the cost of the individual discs but also because of the time that the finning machine is rendered inoperable and because of the time of the machine operator which must be spent to replace the disc. As a practical matter, these costs are a very real factor limiting the widths of the discs that may be employed with prior art tube finning methods and apparatus and, consequently, limiting the pitch of the tube fins that can be formed by these methods and apparatus.

Moreover, with the above-described finning operation, for every revolution about its axis, the tube longitudinally moves forward a distance equal to an integral number of disc widths, usually one, two, or three disc widths. Hence, the forward speed of the tube through the finning machine is dependent on the widths of the discs; and decreasing the widths of the discs in order to increase the fin pitch, decreases the forward speed of the tube through the finning machine. This increases the length of time required to fin a given length of tube, reducing the efficiency of the tube finning machine and of the machine operator.

SUMMARY OF THE INVENTION

An object of the present invention is to provide apparatus and methods for forming very high pitch fins on tube surfaces at substantially the same rate at which more conventional fins are formed.

Another object of this invention is to reduce the stresses on narrow discs used to form very high pitched fins on tube surfaces.

These and other objects are attained with apparatus for forming fins on a tube surface comprising a plurality of roller assemblies defining longitudinal axes laterally spaced from, substantially equally spaced around, and slightly skewed relative to a central, longitudinal axis along which a tube advances during a finning operation. Each roller assembly comprises a rotatable arbor, and a plurality of discs mounted on the arbor for rotation therewith. A first set of discs have substantially uniform widths and progressively increasing outside diameters in a forward direction. A second set of discs have substantially uniform widths generally equal to half the width of each disc in the first set of discs, are located forward of the first set of discs, and include a first and second subset of discs. The first subset of discs have outside diameters generally equal to the outside diameter of the forwardmost disc in the first set of discs. The second subset of discs alternate with the first subset of discs and have progressively increasing outside diameters in the forward direction, with the outside diameter of the forwardmost disc in the second subset of discs generally equal to the outside diameter of the forwardmost disc in the first set of discs. Each roller assembly further comprises spacing means mounted on the arbor between the first and second sets of discs.

A BRIEF DESCRIPTION OF THE DRAWINGS

A DETAILED DESCRIPTION OF THE PREFERRED EMBODIMENT

Figure 1:
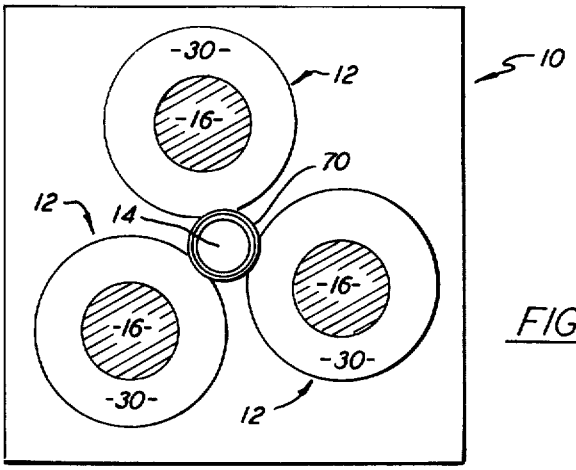
FIG. 1 is a front, diagrammatic view of apparatus for forming fins on a tube.
Figure 2:
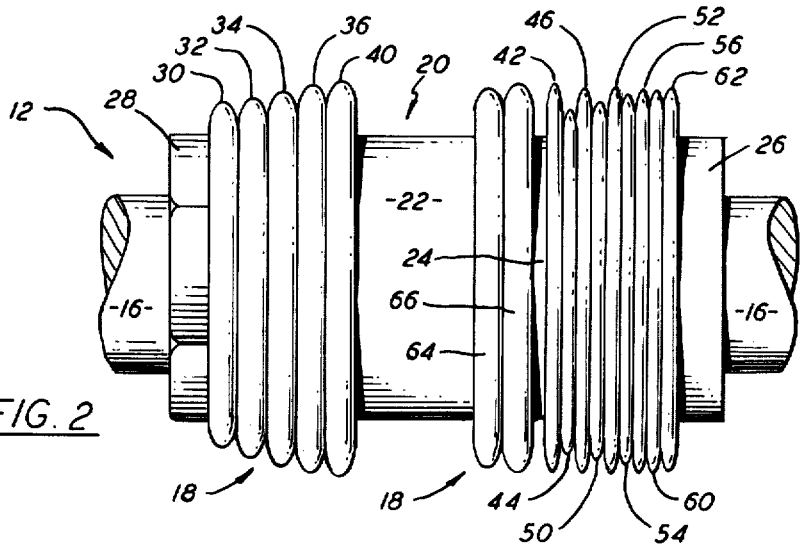
FIG. 2 is a diagrammatic elevational view of one roller assembly of the tube finning apparatus shown in FIG. 1.
Figure 3:
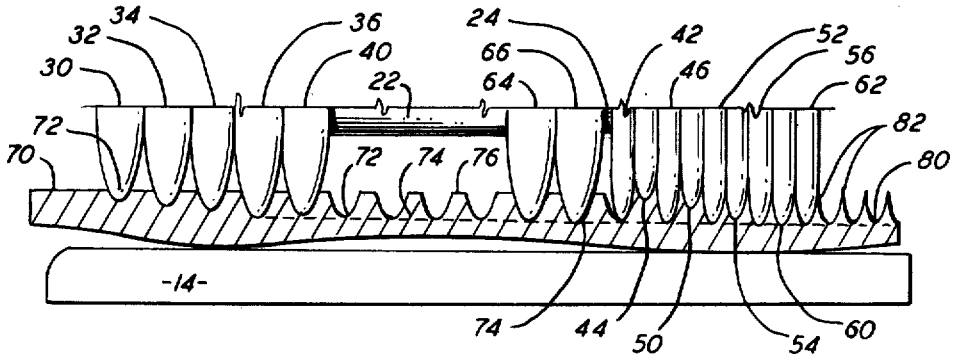
FIG. 3 is a partial sectional view of a heat exchange tube engaging the roller assembly shown in FIG. 2 and showing the progression of the dics of the roller assembly along the surface of the tube.

FIG. 1 illustrates in block form appartus 10 for forming fins on a tube surface in accordance with the present invention. Appartus 10 comprises a plurality of, preferably three, roller assemblies 12 defining longitudinal axes laterally spaced from, substantially equally spaced around, and slightly skewed relative to a central, longitudinal axis along which a tube advances during a finning operation, and preferably apparatus 10 further comprises mandrel 14 extending colinearally with this central, longitudinal axis to guide movement of the tube during the finning operation. Roller assemblies 12 are substantially identical. Consequently, only one roller assembly 12 will be described at length, and FIG. 2 illustrates a roller assembly in greater detail. Generally, assembly 12 comprises arbor 16, a group of discs generally referenced as 18, and spacing means 20, and preferably this spacing means includes first and second spacers or cylinders 22 and 24.

As is conventional, arbor 16 has a cylindrical, axially extending shape, and discs 18 are mounted on the arbor and secured thereto, for instance by keys (not shown), so that the discs and the arbor rotate unitarily. The outside, annular surfaces of discs 18 have arcuate profiles, curving radially inward from a central annular edge. Spacing means 20, specifically cylinders 22 and 24 thereof, are also mounted on arbor 16 and preferably are connected thereto for unitary rotation with the arbor. The assembly of discs 18 and cylinders 22 and 24 are fitted between a radially extending flange 26 of arbor 16 and a lock nut 28 or similar means to secure releasably the discs and spacing cylinders against axial movement.

A first set of discs 30, 32, 34, 36 and 40 have substantially uniform widths and progressively increasing outside diameters in a forward direction (from left to right as viewed in FIG. 2). The first set of discs are provided for forming primary fins on a tube surface, and preferably these discs are contiguous to one another. A second set of discs 42, 44, 46, 50, 52, 54, 56, 60 and 62 have substantially uniform widths generally equal to half the width of each disc in the first set of discs, and are located forward of the first set of discs. The second set of discs are provided for forming secondary fins on the tube surface, and preferably these discs are contiguous to one another.

A first subset of discs 42, 46, 52, 56 and 62 in the second set thereof have outside diameters generally equal to the outside diameter of the forwardmost disc 40 in the first set of discs. A second subset of discs 44, 50, 54 and 60 in the second set of discs alternate with the first subset of discs and have progressively increasing outside diameters in the forward direction, with the outside diameter of the forward-most disc 60 in the second subset thereof generally equal to the outside diameter of the forwardmost disc 40 in the first set thereof.

With the preferred embodiment of roller assembly 12 illustrated in the drawing, a third set of discs 64 and 66 are mounted on arbor 16 between the first and second sets of discs. Preferably the discs in the third set thereof have uniform axial widths, generally equal to the axial width of each disc in the first set of discs, and the forwardmost disc 66 in the third set of discs has an outside diameter substantially equal to the outside diameter of the forward-most disc 40 in the first set of discs.

Spacing means 20 is mounted on arbor 16 between the first and second sets of discs to separate these sets of discs. Specifically, first spacer or cylinder 22 is mounted on arbor 16 between the first and third sets of discs, while second spacer or cylinder 24 is mounted on the arbor between the third and second sets of discs. For example, first cylinder 24 may have an axial width approximately nine and a half times the axial width of individual discs in the first and third sets thereof, and second cylinder 26 may have an axial width equal to that of individual discs in the second set thereof.

Referring now to all three Figures in the drawing, to form fins on a tube, an unfinned tube 70 is placed over mandrel 14, between roller assemblies 12. Roller assemblies 12, as is conventional, are movably supported on finning apparatus 10 for movement toward and away from mandrel 14, allowing discs 18 to be moved into and out of pressure engagement with a tube mounted on the mandrel. Assemblies 12, specifically the rearwardmost, or lead, discs 30 thereof, are brought into pressure contact with the outside surface of tube 70 at a small angle relative to the longitudinal axis thereof. Arbors 16 are then rotated about their own longitudinal axes, rotating lead discs 30 against the outside surface of tube 70. This rotation of lead discs 30 rotates tube 70 about its own longitudinal axis and forms a small, primary groove 72 in the outside surface thereof. The rotation of lead discs 30 against tube 70, because of the skewed angle between the longitudinal axes of the tube and roller assemblies 12, also longitudinally advances the tube so that groove 72 helically extends around the outside surface thereof.

As tube 70 longitudinally moves forward, groove 72 is sequentially engaged by successive discs 32, 34, 36 and 40. These discs, having successively increasing outside diameters, enlarge and form groove 72. In its final form, the bottom centerline of groove 72 helically extends around the longitudinal axis of tube 70, defining a cylindrical, base surface 74 thereof. The successively larger discs 32, 34, 36 and 40 also extrude tube material outward, between adjacent discs, forming helical fin 76 extending around the outside surface of tube 70. The arcuate profile of adjacent discs in the first set thereof shape the extruded material into the form of a relatively flat peak fin 76. It should be noted that, even though the first set of discs form a continuous, helical groove 72 and fin 76 in the outside surface of tube 70, the groove and fin are commonly referred to as being comprised of a plurality of grooves and fins respectively or of a plurality of groove and fin convolutions respectively since a longitudinal cross sectional view of the tube shows a plurality of alternating valleys and peaks.

As a portion of tube 70 moves past the forwardmost disc 40 in the first set thereof, continued advancement of the tube moves that portion thereof past spacer or cylinder 22, which does not engage the tube. Cylinder 22 thus provides a pause in the working of the tube surface, allowing internal stresses, which have developed in tube 70 during formation of primary groove 72 and primary fin 76, to equalize. Further forward movement of tube 70 brings the third set of discs 62 and 64 into engagement with groove 72. These discs, having generally the same outside diameter as the forwardmost disc 40 in the first set of discs, do not further form grooves 72 or fin 76; however, these discs, along with second cylinder 24, insure proper alignment of the primary groove and primary fin with the following, thinner discs of the second set of discs.

Following the third set of discs and cylinder 24, the tube surface is engaged by the second set of discs. In particular, first subset of discs 42, 46, 52, 56 and 62 extend into primary groove 72 and engage base surface 74 of the tube; and second subset of discs 44, 50, 54 and 60 engage the top peak of primary fin 76. The rearwardmost, or lead, disc 44 of the second subset of discs forms a small, secondary helical groove 80 in primary fin 76. As tube 70 continues to advance, secondary groove 80 is sequentially engaged by successive discs 50, 54 and 60. These successive discs, having successfully increasing outside diameters, enlarge and form secondary groove 80, splitting primary fin 76 inward generally to base surface 74 to form a pair of secondary fins 82, preferably of substantially equal width. The successively larger discs 50, 54 and 60 also extrude tube material outward, further forming secondary fins 82. The first subset of discs, having diameters generally equal to the diameter of forwardmost disc 40 in the first set of discs, do not significantly further deepen primary groove 72, but the arcuate profiles of the first subset of discs are employed, in combination with the arcuate profiles of the second subset of discs, to shape the material extruded by the latter subset of discs into the form of relatively sharp peak, secondary fins 82.

In order to simplify the illustration and explanation of the present invention, apparatus 10 as described above forms a single primary groove 72 and one pair of secondary grooves 80, comprising what is referred to as a single lead assembly. As will be apparent to those skilled in the art, by changing the number of roller assemblies 12 and varying the skew angle between the longitudinal axis of tube 70 and the longitudinal axes of the roller assemblies, fin forming apparatus 10 may be used to form three or six primary grooves 72 and three or six pairs of secondary grooves 80, comprising what are referred to as triple or six lead assemblies respectively. A triple lead fin forming apparatus in accordance with the present invention has been effectively employed to provide tubes with a very high fin pitch such as 18 fins per centimeter (46 fins per inch). The specific dimensions of the discs 18 and spacing means 20 of this fin forming apparatus were as follows:

Discs 30, 32, 34, 36 and 40 had widths of approximately 0.099 centimeters (0.039 inches) and diameters ranging from 5.154 centimeters (2.029 inches) to 5.245 centimeters (2.065 inches);

Discs 64 and 66 had widths of approximately 0.099 centimeters (0.039 inches) and diameters of 5.215 centimeters (2.053 inches) and 5.245 centimeters (2.065 inches) respectively;

Discs 42, 46, 52, 56 and 62 had widths of approximately 0.0457 centimeters (0.018 inches) and diameters ranging between 5.245 centimeters (2.065 inches) and 5.258 centimeters (2.070 inches);

Discs 44, 50, 54 and 60 had widths of approximately 0.0457 centimeters (0.018 inches) and diameters varying between 5.169 centimeters (2.035 inches) and 5.258 centimeters (2.070 inches); and Cylinders 22 and 24 had widths of 0.940 centimeters (0.370 inches) and 0.0178 centimeters (0.007 inches) respectively.

The tube finning apparatus and method disclosed above have several advantages compared to the prior art apparatus and methods. For example, it is believed that by first forming primary fin 76 and then using thin discs 44, 50, 54 and 60 to split this primary fin into the very high pitch, secondary fins 82—as opposed to working an unformed tube surface initially with the thin discs to form the high pitch fins—the stresses on the thin discs are substantially reduced, significantly decreasing the number and frequency of broken discs.

In addition, as discussed earlier, with conventional prior art tube finning methods and apparatus, the finning discs have uniform widths which both determine the fin pitch of a tube and also determine, in part, the forward speed of the tube through the finning machine. With the present invention, in contrast, the forward speed of tube 70 is determined by the widths of discs in the first set thereof, while the fin pitch of the tube is determined by the widths of discs in the second set thereof, which are only half as wide as those in the first set. Thus, the present invention may be effectively employed to advance a tube at the same rate as a prior art method or apparatus while providing twice the fin pitch of that method or apparatus.

While it is apparent that the invention herein disclosed is well calculated to fulfill the objects stated above, it will be appreciated that numerous modifications and embodiments may be devised by those skilled in the art, and it is intended that the appended claims cover all such modifications and embodiments as fall within the true spirit and scope of the present invention.

What is claimed is:

1. Apparatus for forming fins on a tube surface comprising a plurality of roller assemblies defining longitudinal axes laterally spaced from, substantially equally spaced around, and slightly skewed relative to a central, longitudinal axis along which a tube advances during a finning operation, each roller assembly comprising:

a rotatable arbor;

a plurality of discs mounted on the arbor for rotation therewith, and including a first set of discs having substantially uniform widths, and progressively increasing outside diameters in a forward direction, and a second set of discs having substantially uniform widths generally equal to half the width of each disc in the first set of discs, located forward of the first set of discs, and including a first subset of discs having outside diameters generally equal to the outside diameter of the forwardmost disc in the first set of discs, and a second subset of discs alternating with the first subset of discs and having progressively increasing outside diameters in the forward direction, with the outside diameter of the forwardmost disc in the second subset of discs generally equal to the outside diameter of the forwardmost disc in the first set of discs; and spacing means mounted on the arbor between the first and second sets of discs.

2. Apparatus as defined by claim 1 wherein:

the discs further include a third set of discs mounted on the arbor between the first and second sets of discs, with the forwardmost disc in the third set of discs having an outside diameter substantially equal to the outside diameter of the forwardmost disc in the first set of discs; and the spacing means includes a first cylinder mounted on the arbor between the first and third sets of discs and a second cylinder mounted on the arbor between the second and third sets of discs.

3. Apparatus as defined by claim 2 wherein the discs in the third set thereof have uniform widths generally equal to the width of each disc in the first set of discs.

4. Apparatus as defined by claim 3 wherein the second cylinder has a width substantially equal to the width of each disc in the second set of discs.

5. A method of making a finned tube comprising the steps of:

bringing a first set of finning discs into pressure contact with the outside surface of a prime tube;

rotating the first set of finning discs against the outside surface of the tube to form a primary helical fin and corresponding helical groove on the outside surface of the tube, with the helical groove having a bottom centerline which defines a cylindrical, base surface of the tube;

pausing after the formation of the primary helical fin and corresponding helical groove for a period of time sufficient to allow internal stresses, which develop in the tube during the formation of the primary helical fin and the corresponding helical groove, to equalize;

bringing a second set of finning discs into pressure contact with the primary helical fin and the corresponding helical groove, said second set of finning discs including a first subset of discs which extend into the helical groove to engage the base surface of the tube and a second subset of discs which engage the top of the primary helical fin, said first subset of discs having outside diameters generally equal to the outside diameter of the forwardmost disc in the first set of discs and said second subset of discs alternating with the first subset of discs and having progressively increasing outside diameters in the forward direction, with the outside diameter of the forwardmost disc in the second subset of discs generally equal to the outside diameter of the forwardmost disc in the first set of discs; and rotating the second set of finning discs against the primary helical fin and the corresponding helical groove to split the primary helical fin inward generally to the base surface of the tube to form a pair of secondary fins.

6. A method of making a finned tube as defined by claim 5 which further comprises the steps of:

bringing a third set of finning discs into pressure contact with the helical groove, after the step of pausing to allow internal stresses to equalize, to ensure proper alignment of the helical groove and the primary helical fin with the second set of finning discs when the second set of finning discs is brought into pressure contact with the primary helical fin and the corresponding helical groove; and pausing for a selected period of time after the third set of finning discs have aligned the helical groove and the primary helical fin with the second set of finning discs and before the second set of finning discs is brought into pressure contact with the primary helical fin and the corresponding helical groove.

* * * * *